US011322314B2

(12) United States Patent
Son

(10) Patent No.: US 11,322,314 B2
(45) Date of Patent: May 3, 2022

(54) ROTATABLE SWITCH

(71) Applicants: HYUNDAI MOTOR COMPANY, Seoul (KR); KIA MOTORS CORPORATION, Seoul (KR)

(72) Inventor: Ji Wan Son, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 23 days.

(21) Appl. No.: 16/921,426

(22) Filed: Jul. 6, 2020

(65) Prior Publication Data

US 2021/0166892 A1 Jun. 3, 2021

(30) Foreign Application Priority Data

Dec. 3, 2019 (KR) ..... 10-2019-0159244

(51) Int. Cl.
*H01H 3/08* (2006.01)
*H01H 19/14* (2006.01)

(52) U.S. Cl.
CPC ..... *H01H 3/08* (2013.01); *H01H 19/14* (2013.01)

(58) Field of Classification Search
CPC ..... H01H 3/08; H01H 19/14; H01H 1/06; H01H 9/42; H01H 50/54; H01H 50/60; H01H 50/40; H01H 50/24; H01H 19/10; H01H 19/02; H01H 3/28; H01H 19/04; B60R 16/005
See application file for complete search history.

(56) References Cited

U.S. PATENT DOCUMENTS

| | | | | |
|---|---|---|---|---|
| 5,121,089 | A | 6/1992 | Larson | |
| 8,022,794 | B2 | 9/2011 | Nakatsuka et al. | |
| 9,972,452 | B2 | 5/2018 | Okada | |
| 2018/0091144 | A1* | 3/2018 | Kwon | H03K 17/962 |
| 2020/0127427 | A1* | 4/2020 | Shimizu | H01H 50/54 |

FOREIGN PATENT DOCUMENTS

| | | | |
|---|---|---|---|
| JP | 2003-281971 | A | 10/2003 |
| JP | 2008-077949 | A | 4/2008 |
| WO | 2005/041231 | A1 | 5/2005 |

* cited by examiner

*Primary Examiner* — Lheiren Mae A Caroc
(74) *Attorney, Agent, or Firm* — McDonnell Boehnen Hulbert & Berghoff LLP

(57) ABSTRACT

A switch in accordance with one aspect of the disclosure may include a housing connected to a first contact and configured to be rotatable, an electrode provided on an outer surface of the housing and connectable to a second contact outside the housing by rotation of the housing, a coil provided inside the housing and configured to generate a magnetic force, and a spring provided inside the housing and rotating the housing in response to the magnetic force generated by the coil.

14 Claims, 7 Drawing Sheets

<SWITCH OFF STATE>

1
10
20
70
80
+
-
<SWITCH ON → SWITCH OFF>

<SWITCH OFF STATE>

<SWITCH ON STATE>

ROTATABLE SWITCH

CROSS REFERENCE TO RELATED APPLICATIONS

This application is based on and claims priority under 35 U.S.C. § 119 to Korean Patent Application No. 10-2019-0159244, filed on Dec. 3, 2019 in the Korean Intellectual Property Office, the disclosure of which is incorporated herein by reference.

BACKGROUND

1. Field

The disclosure relates to a rotatable switch.

2. Description of the Related Art

Among the various electrical components applied to the vehicle, the component that switches high current generates electronic noise due to the instantaneous voltage difference that occurs during switching. For example, the cooling fan is driven by determining whether the cooling fan is operated in accordance with conditions such as cooling water temperature and A/C operation, and repeats ON/OFF depending on the condition, which generates electronic noise. This is called surge.

FIGS. 1A and 1B illustrate a voltage variation by a conventional switch. Referring to FIGS. 1A and 1B, a conventional switch may cause a sudden voltage change during switching. In addition, the conventional switch may cause a sudden current change during switching. That is, the conventional switch has a problem that can generate a system shock by the surge generated during switching.

Surge voltages may be induced into other components according to their strength, causing malfunctions and failures of other components. Therefore, the strength of the surge voltage must be managed in consideration of the specifications of each electronic component. As a way to prevent surges, there is a method of separately installing devices such as diodes and varistors (variable resistors).

However, when a device such as a diode or a varistor (variable resistor) is added separately, there is a problem in that a circuit must be newly configured, and a circuit configuration must be provided differently according to characteristics of the electronic component.

SUMMARY

Therefore, it is an aspect of the disclosure to provide a rotary switch that may be universally applied to electronic components that generate surges.

In accordance with one aspect of the disclosure, a switch includes a housing connected to a first contact and configured to be rotatable, an electrode provided on an outer surface of the housing and connectable to a second contact outside the housing upon rotation of the housing, a coil provided inside the housing and configured to generate a magnetic force, and a spring provided inside the housing and rotating the housing in response to the magnetic force generated by the coil.

The housing may be spaced apart from the second contact and the electrode may protrude from the outer surface of the housing.

The electrode may be provided to increase the area in contact with the second contact as the housing rotates in one direction when the switch is switched from the OFF state to the ON state, and to reduce the area in contact with the second contact as the housing rotates in the opposite direction to the one direction when the switch is switched from the ON state to the OFF state.

The electrode may be provided in a triangular shape or trapezoidal shape so that the area in contact with the second contact is changed according to the rotation of the housing, and a first side of the electrode may be disposed perpendicular to the direction of rotation of the housing.

The electrode provided in the triangular shape may be connected to the second contact from the vertex of the electrode when the switch is switched from the OFF state to the ON state.

The electrode provided in the trapezoidal shape may include a second side shorter than the first side and facing the first side, and may be connected to the second contact from the second side by the rotation of the housing when the switch is switched from the OFF state to the ON state.

One end of the spring may include a magnetic member connected to the electrode, and the other end of the spring may be fixed in a state spaced apart from the inner surface of the housing.

The magnetic member may move to a position corresponding to the second contact in the one direction in response to the magnetic force when the switch is switched from the OFF state to the ON state.

The housing may rotate in the opposite direction by the restoring force of the spring when the switch is switched from the ON state to the OFF state.

The switch may further include a core provided at a predetermined position within the housing corresponding to the second contact and magnetized by the coil.

The spring may have an arc shape corresponding to the inner surface of the housing.

The housing may be a conductor and have a cylindrical shape or a spherical shape.

The electrode may have an area larger than the second contact.

BRIEF DESCRIPTION OF THE FIGURES

These and/or other aspects of the disclosure will become apparent and more readily appreciated from the following description of the embodiments, taken in conjunction with the accompanying drawings of which.

DETAILED DESCRIPTION

Figure 1A:
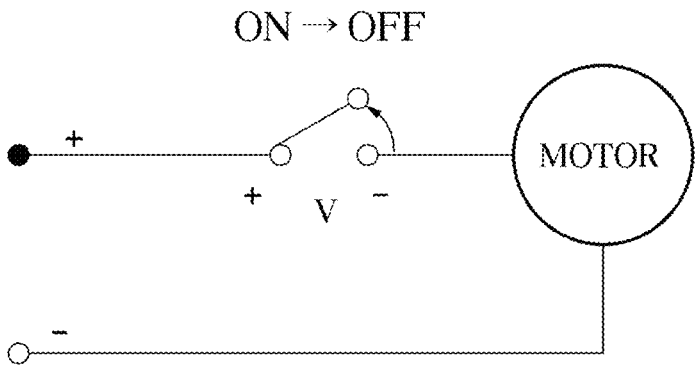
FIG. 1A PRIOR ART
FIGS. 1A and 1B illustrate a voltage variation by a conventional switch.
Figure 1B:
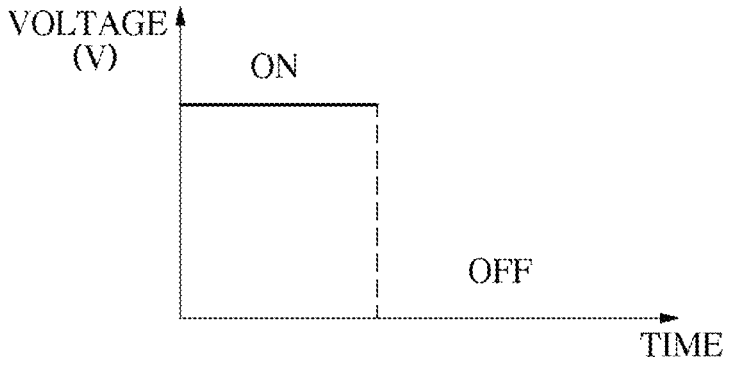
FIG. 1B PRIOR ART

Like reference numerals refer to like elements throughout the specification. Not all elements of embodiments of the disclosure will be described, and description of what are commonly known in the art or what overlap each other in the embodiments will be omitted. The terms as used throughout the specification, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be understood that when an element is referred to as being "connected" to another element, it can be directly or indirectly connected to the other element, wherein the indirect connection includes "connection" via a wireless communication network.

Also, when a part "includes" or "comprises" an element, unless there is a particular description contrary thereto, the part may further include other elements, not excluding the other elements.

It will be understood that, although the terms first, second, third, etc., may be used herein to describe various elements, it should not be limited by these terms. These terms are only used to distinguish one element from another element.

As used herein, the singular forms "a," "an" and "the" are intended to include the plural forms as well, unless the context clearly indicates otherwise.

An identification code is used for the convenience of the description but is not intended to illustrate the order of each step. Each of the steps may be implemented in an order different from the illustrated order unless the context clearly indicates otherwise.

Hereinafter, the operation principles and embodiments of the disclosure will be described with reference to the accompanying drawings.

Figure 2A:
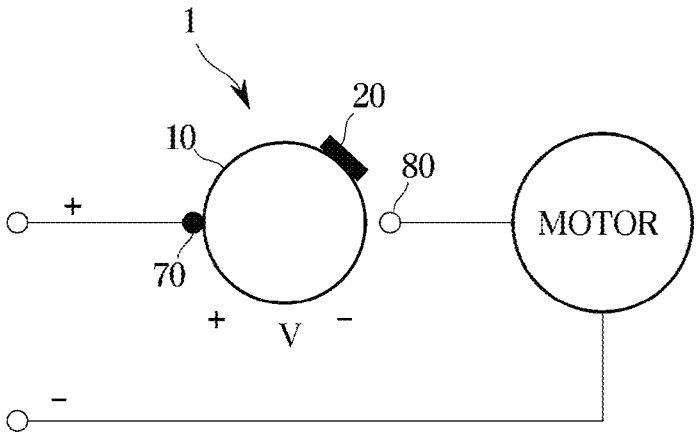
FIGS. 2A and 2B illustrate a voltage change by a switch according to an embodiment of the disclosure.
Figure 2B:
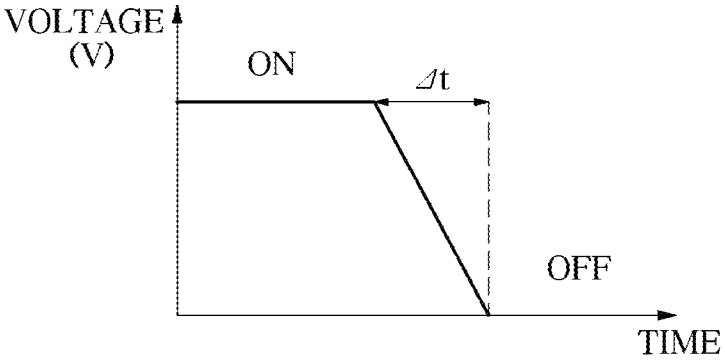

FIGS. 2A and 2B illustrate a voltage change by a switch according to an embodiment of the disclosure.

Referring to FIGS. 2A and 2B, the switch 1 according to an embodiment includes an electrode 20 provided on an outer surface of the housing 10 and rotating together with the housing 10. The housing 10 of the switch 1 is connected to the first contact 70 and spaced apart from the second contact 80. The electrode 20 may be connected to the second contact 80 upon rotation of the housing 10. As the electrode 20 is connected to the second contact 80, current may flow between the first contact 70 and the second contact 80.

The area where the electrode 20 contacts the second contact 80 may vary with the rotation of the housing 10. As shown in the graph of FIG. 2B, according to the switch 1, the change time $\Delta t$ of the voltage at both ends of the switch 1 is increased during switching. Accordingly, sudden voltage fluctuations may be prevented from occurring at both ends of the switch 1, and surge may be reduced.

Hereinafter, the structure of the switch 1 according to an embodiment will be described in detail.

Figure 3:
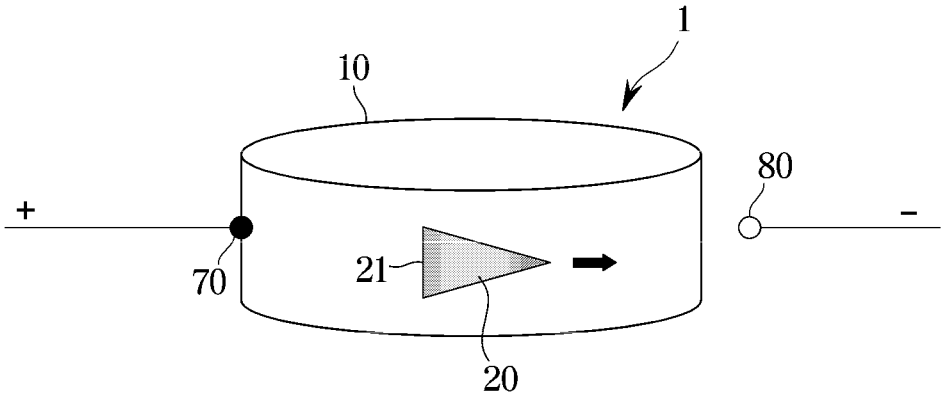
FIG. 3 illustrates an appearance of a switch according to an embodiment of the disclosure.
Figure 4:
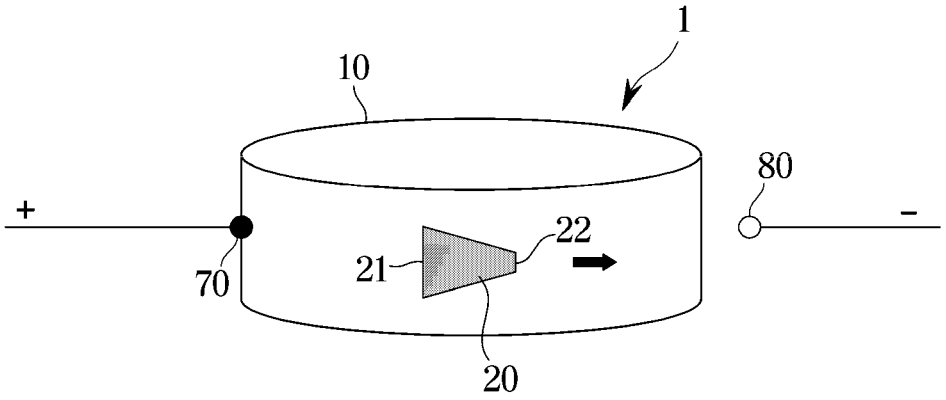
FIG. 4 illustrates another form of an electrode provided in a switch according to an embodiment of the disclosure.
Figures 5A, 5B, 5C, 5D, 5E, 5F:
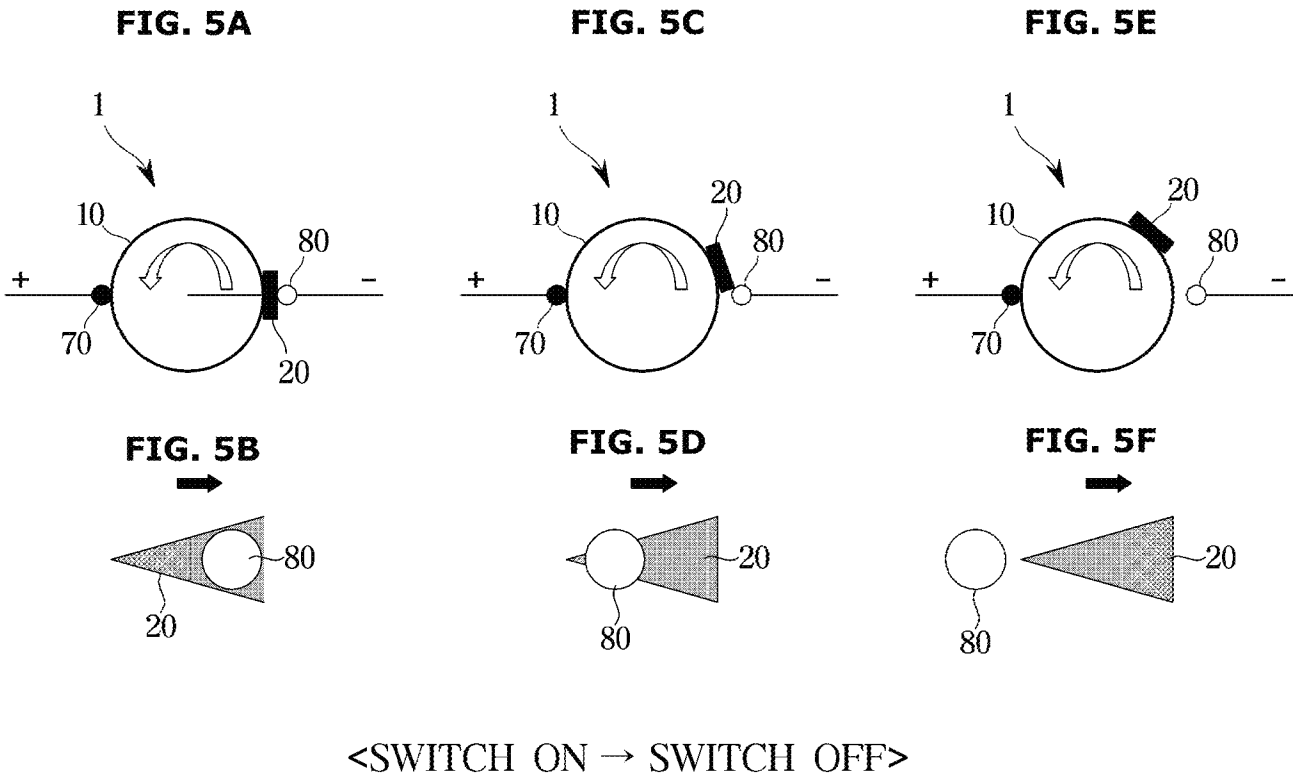
FIGS. 5A, 5B, 5C, 5D, 5E, and 5F illustrate that the switch is turned to the OFF state by rotating according to an embodiment of the disclosure.

FIG. 3 illustrates an appearance of a switch according to an embodiment of the disclosure. FIG. 4 illustrates another form of an electrode provided in a switch according to an embodiment of the disclosure. FIGS. 5A, 5B, 5C, 5D, 5E, and 5F illustrate that the switch is turned to the OFF state by rotating according to an embodiment of the disclosure.

Referring to FIG. 3, the switch 1 according to an embodiment may include a housing 10 rotatable and connected with a first contact 70, and an electrode 20 provided on an outer surface of the housing 10 and connectable to a second contact 80 outside the housing 10 upon rotation of the housing 10. The housing 10 is provided to be spaced apart from the second contact 80. The second contact 80 may be provided in a circular shape. The second contact 80 may have a certain area.

The electrode 20 is provided to protrude from the outer surface of the housing 10. That is, the electrode 20 may protrude to have a predetermined height from the outer surface of the housing 10. The electrode 20 is provided to have a larger area than the second contact 80.

When the switch is switched from the OFF state to the ON state, the electrode 20 may increase the area in contact with the second contact 80 as the housing 10 rotates in one direction. In addition, the electrode 20 may reduce the area in contact with the second contact 80 as the housing 10 rotates in the opposite direction when the switch is switched from the ON state to the OFF state. The electrode 20 may be provided in a triangular shape or a trapezoidal shape, and the first side 21 of the electrode 20 may be disposed perpendicular to the rotation direction of the housing 10. FIG. 3 illustrates an embodiment in which the electrode 20 is provided in a triangular shape. FIG. 4 illustrates another embodiment in which the electrode 20 is provided in a trapezoidal shape. The shape of the electrode 20 is not limited to that illustrated, and may be implemented in other forms.

The electrode 20 provided in a triangular shape may be connected to the second contact 80 from the vertex of the electrode 20 when the switch is switched from the OFF state to the ON state. In contrast, referring to FIGS. 5A, 5B, FIGS. 5C, 5D, 5E and 5F, when the switch is switched from the ON state to the OFF state, the housing 10 may rotate counterclockwise. In this case, in the electrode 20 having a triangular shape, the first side 21 of the electrode 20 may be far from the second contact 80. Therefore, the area where the electrode 20 and the second contact 80 contact may vary according to the rotation of the housing 10.

In other words, when the switch OFF signal is transmitted from the engine control unit (ECU) of the vehicle, the housing 10 of the switch 1 may start to rotate counterclockwise. As the first side 21 of the electrode 20 is first separated from the second contact 80, the area where the electrode 20 and the second contact 80 contact decreases. When the electrode 20 and the second contact 80 are completely separated, the switch OFF is completed. As the area where the electrode 20 and the second contact 80 contact decreases, the voltage V applied between the first contact 70 and the second contact 80 decreases. In addition, since the voltage V applied between the first contact 70 and the second contact 80 gradually decreases for a predetermined time, the occurrence of surge may be reduced. The predetermined time may be 1 ms or more. As such, when the switch is switched to the OFF state or the ON state, by increasing the transient period, it is possible to reduce the sudden voltage fluctuations or sudden current fluctuations between the both ends of the switch (1).

On the other hand, the electrode 20 provided in a trapezoidal shape includes a second side 22 that is shorter than the first side 21 and faces the first side 21, and when the switch is switched from the OFF state to the ON state, the second side 22 may first be connected to the second contact 80 by the rotation of the housing 10. The second side 22 is provided shorter than the diameter of the second contact 80. On the contrary, when the switch is switched from the ON state to the OFF state, the first side 21 of the electrode 20 provided in the trapezoidal shape may first move away from the second contact 80. Therefore, the area where the electrode 20 and the second contact 80 contact may vary according to the rotation of the housing 10.

Figure 6:
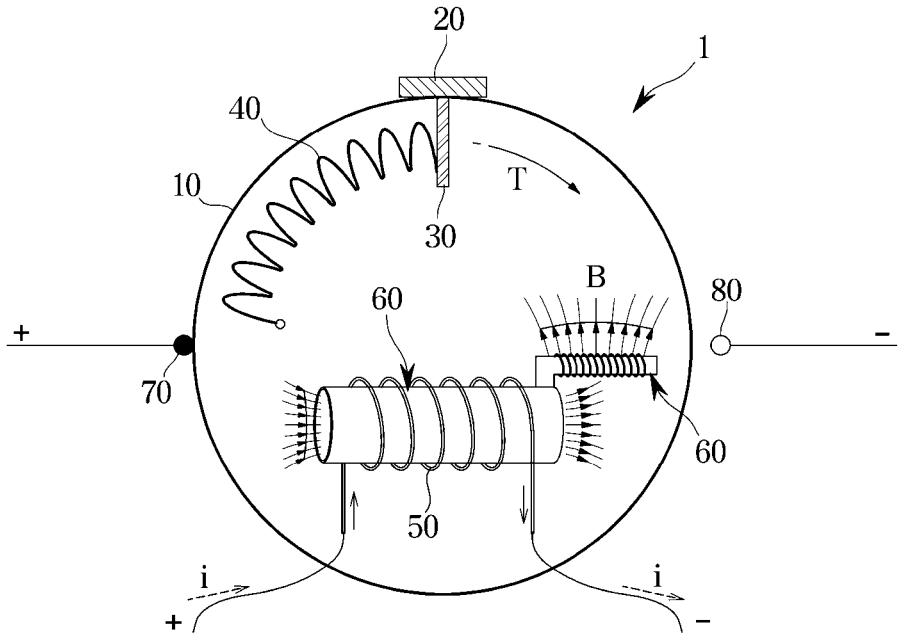
FIG. 6 illustrates an internal structure when the switch is in an OFF state according to an embodiment of the disclosure.
Figure 7:
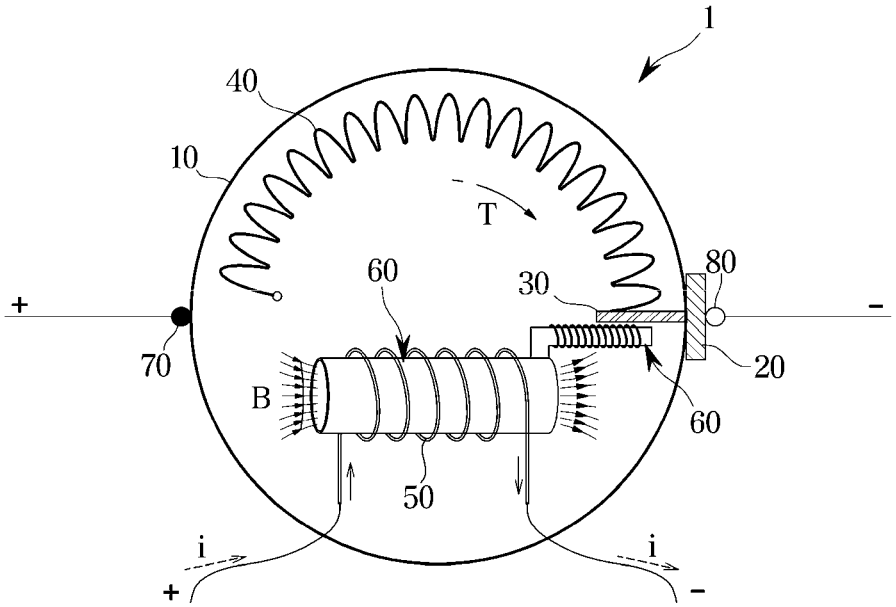
FIG. 7 illustrates an internal structure when the switch is in an ON state according to an embodiment of the disclosure.

FIG. 6 illustrates an internal structure when the switch is in an OFF state according to an embodiment of the disclosure. FIG. 7 illustrates an internal structure when the switch is in an ON state according to an embodiment of the disclosure.

Referring to FIG. 6, the switch 1 may include a housing 10 rotatably connected with a first contact 70, and may include an electrode 20 provided on an outer surface of the housing 10 and connectable with a second contact 80 outside the housing 10 upon rotation of the housing 10. The housing 10 is provided to be separated from the second contact 80. The second contact 80 may be provided in a circular shape. The second contact 80 may have a certain area. The housing 10 may be provided as a conductor and may have a cylindrical shape or a sphere shape. The shape of the housing 10 is not limited to that illustrated and may be provided in various shapes.

In addition, the switch 1 includes a coil 50 provided inside the housing 10 and generating a magnetic force B, and includes a spring 40 provided inside the housing 10 and rotating the housing 10 in response to a magnetic force B generated by the coil 50. When a current is applied to the coil 50 from an external power source, the coil 50 generates a magnetic force.

The switch 1 may further include a core 60 provided at a predetermined position inside the housing 10 corresponding to the second contact 80 and magnetized by the coil 50. For example, the coil 50 may be wound around the core 60. Stronger magnetic forces can be generated by the core 60. The core 60 may be provided in a rod shape. In addition, the core 60 may be provided in a curved bar shape. The shape of the core 60 is not limited to that illustrated and may be provided in various shapes.

In addition, one end of the spring 40 may include a magnetic member 30 connected to the electrode 20, and the other end of the spring 40 may be fixed in a state spaced apart from the inner surface of the housing 10. The spring 40 may have an arc shape corresponding to the inner surface of the housing 10.

The spring 40 and the coil 50 may be disposed on a substrate provided in the housing 10. For example, when the housing 10 is provided in a cylindrical shape, the substrate may be a lower surface of the housing 10, and the lower surface of the housing 10 may be provided to be separated from the side to rotate only the side of the housing 10. Positions of the spring 40 and the coil 50 are not limited to those illustrated, and may be provided in various structures that can be separated from the housing 10.

FIG. 6 illustrates the state and position of the spring 40 when the switch 1 is in the OFF state. The magnetic member 30 at one end of the spring 40 may move to a position corresponding to the second contact 80 in one direction (e.g., clockwise direction) in response to the magnetic force B when the switch is switched from the OFF state to the ON state. That is, the magnetic force generated by the coil 50 provides the force T for pulling the magnetic member 30. Since the magnetic member 30 is connected to the electrode 20, the housing 10 and the electrode 20 may rotate according to the movement of the magnetic member 30. As shown in FIG. 7, the electrode 20 may be connected to the second contact 80 according to the movement of the magnetic member 30.

The housing 10 may rotate in a direction opposite to one direction by the restoring force of the spring 40 when the switch is switched from the ON state to the OFF state. That is, when no current flows in the coil 50, the magnetic force applied to the spring 40 disappears, so that the spring 40 may be restored.

In this way, the disclosed switch has a structure that can increase the transient period during switching, it is possible to reduce the occurrence of surge.

The disclosed switch can be applied universally to various electronic components, and does not require the addition of a diode or a varistor (variable resistor) to prevent the occurrence of surge, thereby contributing to the simplification of the circuit and the compactness of the package.

The exemplary embodiments of the disclosure have thus far been described with reference to the accompanying drawings. It will be obvious to those of ordinary skill in the art that the disclosure may be practiced in other forms than the exemplary embodiments as described above without changing the technical idea or essential features of the disclosure. The above exemplary embodiments are only by way of example, and should not be interpreted in a limited sense.

The invention claimed is:

1. A switch comprising:

a housing connected to a first contact and configured to be rotatable;

an electrode provided on an outer surface of the housing and connectable to a second contact outside the housing upon rotation of the housing;

a coil provided inside the housing and configured to generate a magnetic force; and a spring provided inside the housing and rotating the housing in response to the magnetic force generated by the coil.

2. The switch according to claim 1, wherein the housing is spaced apart from the second contact and the electrode protrudes from the outer surface of the housing.

3. The switch according to claim 1, wherein the electrode is configured to increase an area in contact with the second contact as the housing rotates in one direction when the switch is switched from an OFF state to an ON state, and to reduce the area in contact with the second contact as the housing rotates in an opposite direction to the one direction when the switch is switched from the ON state to the OFF state.

4. The switch according to claim 3, wherein the electrode comprises a triangular shape or trapezoidal shape so that the area in contact with the second contact is changed according to the rotation of the housing, and a first side of the electrode is disposed perpendicular to the direction of rotation of the housing.

5. The switch according to claim 4, wherein the electrode having the triangular shape is connected to the second contact from a vertex of the electrode when the switch is switched from the OFF state to the ON state.

6. The switch according to claim 4, wherein the electrode having the trapezoidal shape comprises a second side shorter than the first side and facing the first side, and is connected to the second contact from the second side by the rotation of the housing when the switch is switched from the OFF state to the ON state.

7. The switch according to claim 6, wherein the magnetic member moves to a position corresponding to the second contact in the one direction in response to the magnetic force when the switch is switched from the OFF state to the ON state.

8. The switch according to claim 3, wherein one end of the spring comprises a magnetic member connected to the electrode, and an other end of the spring is fixed in a state spaced apart from an inner surface of the housing.

9. The switch according to claim 3, wherein the housing rotates in the opposite direction by a restoring force of the spring when the switch is switched from the ON state to the OFF state.

10. The switch according to claim 1, further comprising:

a core provided at a predetermined position within the housing corresponding to the second contact and magnetized by the coil.

11. The switch according to claim 1, wherein the spring has an arc shape corresponding to an inner surface of the housing.

12. The switch according to claim 1, wherein the housing is a conductor and has a cylindrical shape.

13. The switch according to claim 1, wherein the housing is a conductor and has a sphere shape.

14. The switch according to claim 1, wherein the electrode has an area larger than the second contact.

* * * * *